United States Patent [19]

Arato et al.

[11] 4,074,387

[45] Feb. 21, 1978

[54] VACUUM CLEANER ATTACHMENT

[75] Inventors: Paul Arato, Don Mills; Antony Lelkes, Toronto; Larry Ronald Reid, Scarborough, all of Canada

[73] Assignee: Centaur Floor Machines Ltd., Don Mills, Canada

[21] Appl. No.: 754,726

[22] Filed: Dec. 27, 1976

[51] Int. Cl.[2] ..... A47L 7/00

[52] U.S. Cl. ..... 15/322

[58] Field of Search ..... 15/321, 322; 132/9

[56] References Cited

U.S. PATENT DOCUMENTS

| | | | |
|---|---|---|---|
| 919,606 | 4/1909 | Locke et al. | 15/322 |
| 2,531,370 | 11/1950 | Thompson | 15/321 |
| 3,322,144 | 5/1967 | De Boer et al. | 132/9 X |
| 3,355,762 | 12/1967 | Cavell et al. | 15/321 |
| 3,818,538 | 6/1974 | Kraft | 15/322 |

FOREIGN PATENT DOCUMENTS

| | | | |
|---|---|---|---|
| 899,007 | 5/1972 | Canada | 15/321 |

*Primary Examiner*—Christopher K. Moore

*Attorney, Agent, or Firm*—Hirons & Rogers

[57] ABSTRACT

A vacuum cleaner attachment, especially suited for vacuum cleaning of upholstery, has an applicator head having a first opening for vacuum and a second opening for applying cleaning fluid. Two separate conduits are in fluid communication with the respective openings. At their connections to the applicator head, the conduits are enclosed in a resilient rubber sleeve. The sleeve has two separate longitudinal apertures, one for each conduit, and maintains the two conduits in separated, side-by-side relationship. A valve means is provided in the second conduit to control the supply of cleaning fluid, the valve means being enclosed by the rubber sleeve and manually operable by the operators squeezing the rubber sleeve when application of cleaning fluid is required.

5 Claims, 3 Drawing Figures

VACUUM CLEANER ATTACHMENT

FIELD OF THE INVENTION

This invention relates to devices for attachment to vacuum cleaners. More particularly it relates to vacuum cleaner attachments of the type by which cleaning fluid may be supplied to a location to be cleaned, e.g. upholstery, along with the application of vacuum.

BACKGROUND OF THE INVENTION

Vacuum upholstery cleaners of the above general type are known. Pile and nap fabrics of the type often used in upholstery can be cleaned in a relatively efficient manner by applying cleaning fluid to a location to be cleaned along with the application of vacuum. The tool, which would have relatively small dimensions to allow it to penetrate into joints and crevices is upholstered furniture, is used to disturb the fabric surface so as remove dirt therefrom, and at the same time to apply cleaning fluid to wash the fabric at the location of vacuum, and thereby vacuum remove the cleaning fluid after use, along with the dirt which the fluid has dislodged and freed. Whilst the vacuum supply is normally left on continuously during operation, manual control of the cleaning fluid supply is desirable, so that it may be applied intermittently as desired.

Devices previously proposed and used for this purpose however, have had various diadvantages. Two separate conduits are necessary, one for vacuum and one for cleaning fluid,. These have to be assembled together over the major portion of their lengths, in some simple, efficient but at the same time economical manner, to give a device of pleasing appearance. Sealing problems of the conduits to the head also arise. In one device the fluid supply conduit is located inside the vacuum supplying hose. This however is relatively expensive to manufacture, and leads to heat insulation problems where it is desired to use a heated cleaning fluid in one conduit.

BRIEF SUMMARY OF THE INVENTION

It is an object of the present invention to provide a novel vacuum cleaner attachment especially suited for upholstery cleaning.

It is a further object to provide such a vacuum cleaner attachment which is simple to operate and inexpensive to manufacture whilst at the same tme being of generally pleasing appearance.

Other objects and advantages of the present invention will become apparent from the following description and specification.

Briefly stated, the present invention provides a vacuum cleaner attachment comprising a first conduit having an outlet end adapted to be connected to a vacuum source, and an inlet end; a second conduit having an inlet end adapted to be connected to a source of cleaning fluid, and an outlet end; a valve at the outlet end of said second conduit, the valve having a manually operable operating member adapted to open and close said valve; and an applicator head in fluid communication with the inlet end of the first conduit and the outlet end of the second conduit. There is provided a resilient sleeve having a first longitudinal aperture receiving the first conduit, and a second longitudinal aperture receiving the second conduit, the longitudinal apertures being disposed in generally side-by-side relationship. The operating member of the valve is disposed within the second aperture in the sleeve, and is manually operable in response to manual pressure exerted on the exterior of the sleeve.

The provision of a resilient sleeve, suitably of rubber, in accordance with the present invention, provides a number of significant and advantageous features. The rubber sleeve is sufficiently soft and resilient that the valve operating member, although disposed within the sleeve, can be operated by means of external manual pressure applied to the sleeve. At the same time, the sleeve maintains the conduits in fixed, separated, side-by-side relatonship to one another. It also serves to insulate the first conduit, and the operator's hand, against the heat of hot cleaning fluids which may be used in said second conduit.

DESCRIPTION OF THE PREFERRED EMBODIMENTS

The vacuum cleaner attachment according to the preferred embodiment of the invention has a first conduit comprised of a flexible hose and a rigid tube, integral with the applicator head. The flexible hose is received on the end of the rigid tube, so that the two items together comprise the first conduit for vacuum drawing therethrough. The end of the rigid tube remote from the applicator head and the end of the flexible hose are both received in the first longitudinal aperture of the resilient sleeve, so that the sleeve overlies the communication thereto and improves the connection. Also, the vacuum cleaner attachment according to the invention has an applicator head with first outlet opening in communication with the first conduit, and a second outlet opening in communication with the said second conduit via said valve, both the first outlet opening and the second outlet opening being presented in a direction generally transverse to the longitudinal axis of the sleeve.

BRIEF REFERENCE TO THE DRAWINGS

In the drawings, like reference numerals indicate like parts.

DETAILED DESCRIPTION OF THE SPECIFIC EMBODIMENT

Figure 1:
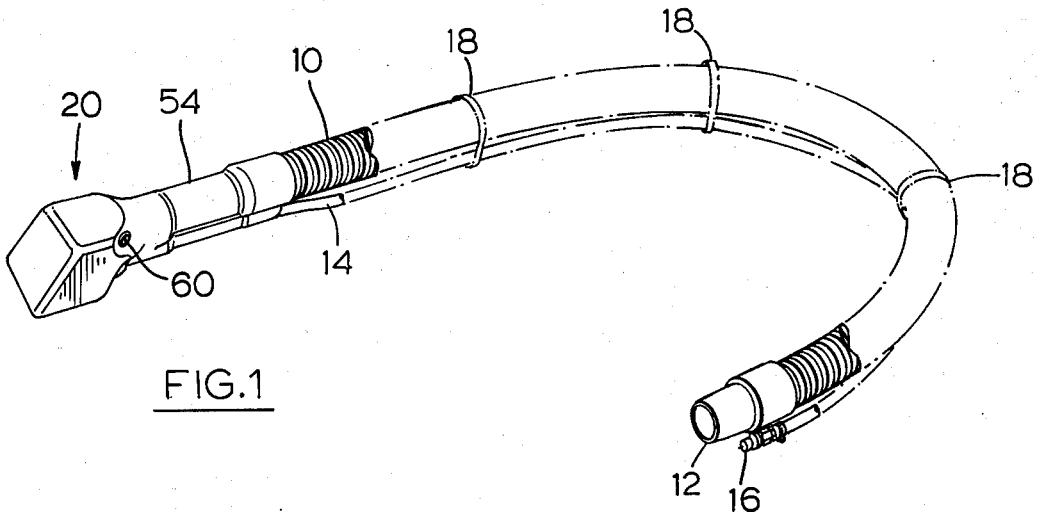
FIG. 1 is a perspective view of the vacuum cleaner attachment of a preferred specific embodiment of the invention.

The vacuum cleaner attachment as illustrated is intended for use in the vacuum cleaning of fabrics, upholstery and the like, with supply of cleaning fluid to the cleaning site. Thus the device has a first large conduit 10 in the form of a corrugated flexible hose of rubber or plastic material, the outlet end 12 of which is adapted to be connected to the vacuum source of a conventional vacuum cleaner. A second, smaller conduit 14 is provided in the form of a flexible tube of rubber or the like, the inlet end 16 of the tube being adapted to be connected to a source of cleaning fluid in the known way. The hose 10 and the cleaning fluid tube 14 are relesably secured together, by clips 18, in side-by-side relationship for the major portion of their lengths remote from their respective ends 12, 16.

The open inlet end of the hose 10 and the outlet end of the tube 14 are connected to an applicator head 20, which is a metal casting. The applicator head 20 has an integral rigid tubular shank 22, to the end of which the hose 10 is connected, fitting tightly thereover. The hose 10 and tubular shank 22 thus form a continuous first conduit, to be connected to the vacuum source. The head 20 also has a body portion 24, in a side wall of which are provided a first, vacuum inlet opening 26 and a second, washing fluid outlet opening 28, the openings thus being presented in a direction generally transverse to the shank 22. The first opening 26 is in direct fluid communication with the tubular shank 22 and hence with the hose 10, so that vacuum action can be applied through opening 26. The first and second oenings 26, 28 are separated from one another, by a dividing wall 30 integral with the body portion 24 of the head 20. The first opening 26 is divided into three narrower apertures by two ribs 32, 34 extending across the opening 26, so as to prevent the drawing into the tubular shank 22 of excessively large objects.

Figure 3:
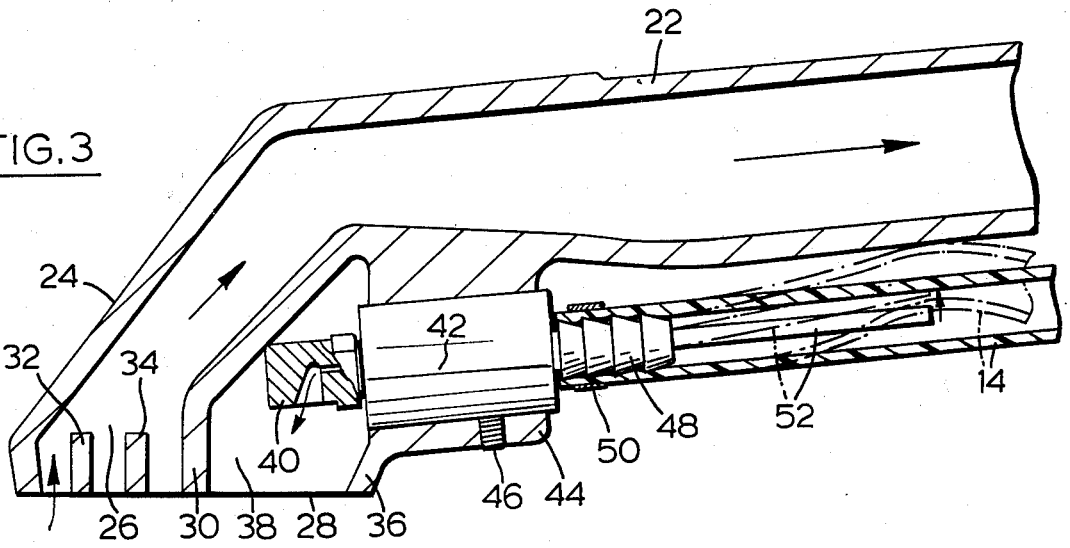
FIG. 3 is a cross-sectional view of the device of FIG. 2.

The integral dividing wall 30, together with an inside end wall 36, former chamber 38 within the applicator head 20, the outlet from which is formed by second outlet opening 28 (FIG. 3). Inside the chamber 38 is disposed a spray nozzle 40, the outlet from which is directed towards the second outlet opening 28. The nozzle 40 is in fluid communication with the outlet end of the tube 14 via a valve 42. The inside end wall 36 is provided with an apertured integral mounting formation 44 extending exteriorly from end wall 36 outside the chamber 38. The valve 42 is securely mounted in the aperture in mounting formation 44 by means of set screw 46. The valve 42 is of generally conventional form so that its structure and operation does not require detailed description. The outlet end of flexible tube 14 is received on mounting formation 48 on the inlet end of the valve 42, and is clamped tightly thereon by means of an exterior encircling band clamp 50. The valve 42 has an operating lever 52 projecting from an inlet end thereof a substantial distance beyond the end of mounting formation 48 and generally concentric therewith, so that the operating lever 52 is disposed within flexible tube 14 when the device is assembled. Valve 42 is opened by deflecting level 52 away from its axial concentric position relative to the valve 42. The nozzle 40 is secured to the outlet end of valve 42 projecting through the integral mounting formation 44 into chamber 38.

Figure 2:
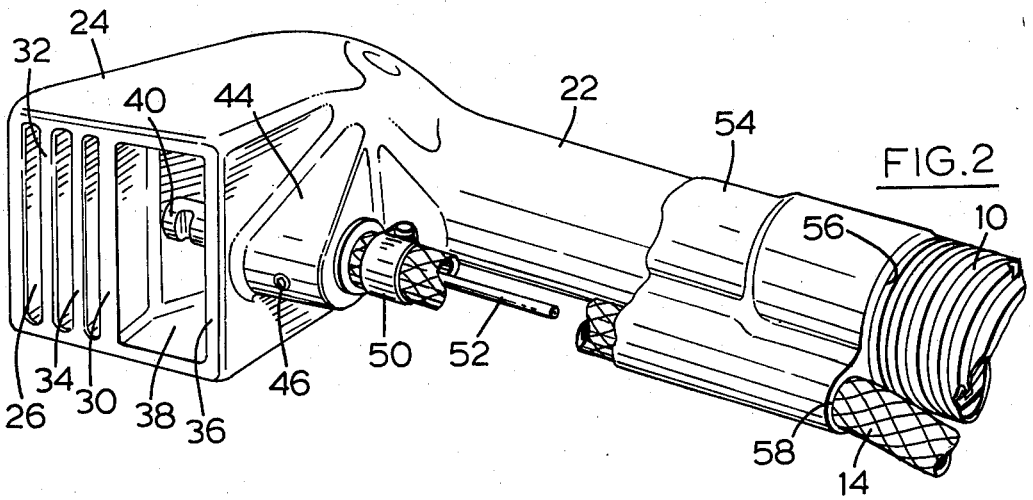
FIG. 2 is a detailed perspective view of the appliator head end of the device shown in FIG. 1, with parts cut away.

A resilient rubber sleeve 54 is provided, which has a first large longitudinal aperture 56, and a second, small longitudinal aperture 58, both extending from the end of the sleeve 54 remote from the head 24, as shown in FIG. 2. The large aperture 56 receives at said end in tight fitting manner the end of hose 10 and elsewhere receives the end of shank 22 of the applicator head, so that the sleeve 54 by means of large aperture 56 overlies and insures the tightness of the connection of hose 10 to shank 22 of the head 20. The small longitudinal aperture receives therein the flexible tube 14, as a tight fit. The two separate apertures 56, 58 extend along the sleeve towards the head 20 a short distance 20 but end and merge into a single aperture in the sleeve 54 short of the distal end of the valve operator 52, so that there is free space within the sleeve 54 between the hose 14 and the shank 22 at that location, as shown in FIG. 3. At its other end, the sleeve 54 is suitably shaped to fit over the end of the body part 24 of the applicator head 20 as shown in FIG. 1 and encloses the flexible tube 14 up to the edge of the mounting formation 44. The end of the sleeve 54 is releasably secured to the head 20 by means of screws such as 60.

The dimensions of the parts are such that the sleeve 54, overlying the shank 22 of the applicator head and the tube 14, can be readily gripped and squeezed by an operator's hand. The sleeve 54 is of resilient, relatively soft rubber. It maintains the hose 10 and shank 22, constituting the first conduit, and the flexible tube 14 constituting the second conduit, in side-by-side relationship and separated, but secured together.

In operation, vacuum is drawn through first opening 26, tubular shank 22 and hose 10 connected to a vacuum cleaner, as indicated by the arrows in FIG. 3. Flexible tube 14 is connected to a source of cleaning fluid, suitably a pressurized source. The cleaning fluid may be organic solvents, water, deteregent solution or the like, and may be hot or cold. The control of cleaning fluid to and through spray nozzle 40 is effected by the operator by squeezng the sleeve 54, at a location where it overlies the valve operating lever 52. Such squeezing action is transmitted through soft resilient rubber sleeve 54 to deflect flexible hose towards the shank 22 into the space between the hose 14 and the shank 22, and thus to deflect operating lever 52, as shown in chain dotted line in FIG. 3, thereby opening the valve. On release of the squeezing action, the resilience of the rubber sleeve ensures that the parts return to their original positions, with the valve operating lever in the axial concentric position and the valve closed. The rubber sleeve 54, suitably of foam rubber polyurethane, also provides heat insulation for the operator's hand, against hot cleaning fluid which may be contained in flexible tube 14.

Thus the invention provides a simple, efficient and readily controlled device by means of which an operator may apply vacuum and cleaning fluids, as desired, to a given location for cleaning purposes. The device is especially suitable for cleaning of upholstered furniture, which has corners and crevices to which it may be difficult properly to apply conventional cleaning devices. The device is easy to operate and manipulate, and relatively simple and inexpensive to manufacture, whilst at the same time being of generally pleasing overall appearance.

It will be appreciated that the embodiments described in detail herein are illustrative only, and many changes and variations can be made to the device without departing from the scope and spirit of the invention. The scope of the invention is limited only by the appended claims.

We claim:

1. A vacuum cleaner attachment comprising:

a first conduit having an outlet end adapted to be connected to a vacuum source, and an inlet end;

a second conduit having an inlet end adapted to be connected to a source of cleaning fluid, and an outlet end;

a valve of the outlet end of said second conduit, the valve having a manually operable operating member adapted to open and close the said valve;

an applicator head in fluid communication with the inlet end of said first conduit and the outlet end of said second conduit;

a resilient sleeve having a first longitudinal aperture receiving the first conduit, and a second longitudinal aperture receiving the second conduit, said longitudinal apertures being disposed in generally side-by-side relationship;

the operating member of said valve being disposed within said sleeve, and being manually operable in response to manual pressure exerted on a portion of the exterior of said sleeve adjacent the underlying operating member.

2. The vacuum cleaner attachment of claim 1 wherein said resilient sleeve is of rubber and provides heat insulation of said second conduit.

3. The vacuum cleaner attachment of claim 2 wherein said first conduit is comprised of a flexible hose and a rigid tube integral with said applicator head, the end of the rigid tube remote from the applicator head and the end of the flexible hose both being received in said first longitudinal aperture of the resilient sleeve.

4. The vacuum cleaner attachment of claim 3 wherein said applicator head has a first inlet opening in communication with said first conduit, and a second outlet opening in communication with said second conduit via said valve, both the first inlet opening and the second outlet opening being presented in a direction generally transverse to the longitudinal axis of the sleeve.

5. The vacuum cleaner attachment of claim 4 wherein the first inlet opening and the second outlet opening are disposed in generally side-by-side relationship in said applicator head, and are displaced laterally with respect to the longitudinal axis of said first conduit, the second conduit being disposed in generally parallel, side-by-side relationship to said first conduit, and being laterally displaced from the longitudinal axis of said first conduit in the same direction as the displacement of said first inlet opening and said second outlet opening therefrom.

* * * * *